United States Patent [19]

Stape et al.

[11] 4,169,646

[45] Oct. 2, 1979

[54] INSULATED CONTACT

[75] Inventors: William J. Stape, Lewisberry; John R. Hopkins, Hershey; Robert N. Weber, Hummelstown, all of Pa.

[73] Assignee: AMP Incorporated, Harrisburg, Pa.

[21] Appl. No.: 851,232

[22] Filed: Nov. 14, 1977

[51] Int. Cl.[2] ..... H01R 13/38

[52] U.S. Cl. ..... 339/99 R

[58] Field of Search ..... 339/97 R, 97 P, 98, 339/99 R

[56] References Cited

U.S. PATENT DOCUMENTS

| | | | |
|---|---|---|---|
| 3,027,536 | 3/1962 | Pasternak | 339/97 R |
| 3,145,261 | 8/1964 | Forney, Jr. | 339/98 |
| 3,728,661 | 4/1973 | Kassabgi | 339/99 R |
| 3,912,354 | 10/1975 | Campbell et al. | 339/99 R |
| 3,930,708 | 1/1976 | Wedekind et al. | 339/99 R |

*Primary Examiner*—Joseph H. McGlynn
*Attorney, Agent, or Firm*—Russell J. Egan

[57] ABSTRACT

An improved electrical terminal is disclosed having a mating first end and a conductor engaging second end which is of the insulation piercing type including at least two tine members defining a conductor engaging slot therebetween. At least a portion of the conductor engaging end of the terminal is coated with a layer of insulation. As a terminal, which has the entire second end coated with insulation, is engaged with a conductor, the tines penetrate the conductor insulation and a portion of the insulation coating is stripped from the slot by the interference fit of the conductor in the slot to effect good mechanical and electrical interconnection therebetween. Also, only the tips of the tines can be coated to assure no electrical contact with any conductor they might engage. Thus the subject terminal may be used on shielded cable when it is desired to interconnect with the conductors but not with the shielding. In cases of cables having conductors on close center lines, where there might be concern about the occurrence of shorting between a terminal and an adjacent conductor, terminals having insulation coating their sides can be used.

8 Claims, 13 Drawing Figures

INSULATED CONTACT

BACKGROUND OF THE INVENTION

1. The Field of the Invention

The present invention relates to an electrical terminal having a mating first end and a conductor engaging second end and in particular to an electrical terminal in which the second end is of the insulation displacing type and is coated with a layer of insulation material on at least a portion thereof.

2. The Prior Art

There are many well known electrical terminals which can be used in an insulation displacing fashion to make electrical connection with multi-conductor cable of the flat or round conductor type. Examples of some of these known terminals can be found in U.S. Pat. Nos. 3,189,863; 3,444,506; and 3,820,055. While such terminals have received wide acceptance in the electrical industries, it is well known that they are not suitable for all applications. For example, the termination of a shielded multi-conductor cable causes particular problems in that the shielding must be removed in the area of the termination in order to prevent the known terminals from shorting between the conductors and the shielding. The current technique for terminating such cable is a costly and slow procedure which requires the insulation to be removed from the cable at the point of termination and on the side adjacent the shielding. This exposes a portion of the shielding which is then removed and the cable terminated in conventional fashion. However, this technique has the additional undesirable characteristic of deteriorating the electrical characteristics of the cable when the shield is removed.

The known terminals such as illustrated in U.S. Pat. Nos. 3,816,818 and 3,930,708 act in what could be termed a linear displacement fashion with the axis of the conductor lying in the plane of the contact, contrary to lying transversely of the contact as with the previously discussed terminals. These linear displacement terminals are generally mounted on very close center lines so that there is a danger that a tine of a terminal could be displaced so as to inadvertently short with an adjacent conductor.

SUMMARY OF THE INVENTION

The present invention relates to an electrical terminal having a mating first end and a conductor engaging second end and consists of coating at least a portion of the second end with a layer of insulation material in order that the terminal may be used for selective engagement with layered conductors and/or engagement with selected conductors on close centers. The second end of the terminal is preferably of the type having at least two tines defining an insulation displacing slot therebetween. In one embodiment, the insulation layer coats the insulation displacing slot of the terminal and is removed by the wiping action of a conductor forced into the insulation displacing slot with an interference fit. In other embodiments, only the tips or the side surfaces of the tines are coated. The insulating coating may be selected from a wide variety of dielectric materials, such as vinyls, enamels, urethane, etc., and may be applied by any of a number of well known techniques including dipping, spraying, plating and electrodeposition.

It is therefore an object of the present invention to improve previously known insulation displacing terminals so that they might be used on extremely close center lines and for terminating shielded cable.

It is a further object of the present invention to teach a method of coating an insulation displacing portion of an electrical terminal so that the terminal can be used to engage conductors of a shielded cable without electrically or mechanically contacting the shielding layer thereof.

It is a further object of the present invention to produce an improved insulation displacing electrical terminal in which the insulation displacing portion of the terminal is coated with an electrical insulating material so that the terminal may be applied to a cable having multiple conductors on close center lines without the risk of shorting between adjacent terminals and/or conductors.

It is a further object of the present invention to produce an improved electrical terminal of the insulation displacing type which is coated with an electrically insulating material and which can be readily and economically manufactured.

The means for accomplishing the foregoing objects and other advantages of the present invention will become apparent to those skilled in the art from the following detailed description taken with reference to the accompanying drawings.

DETAILED DESCRIPTION OF THE PREFERRED EMBODIMENTS

Figure 1:
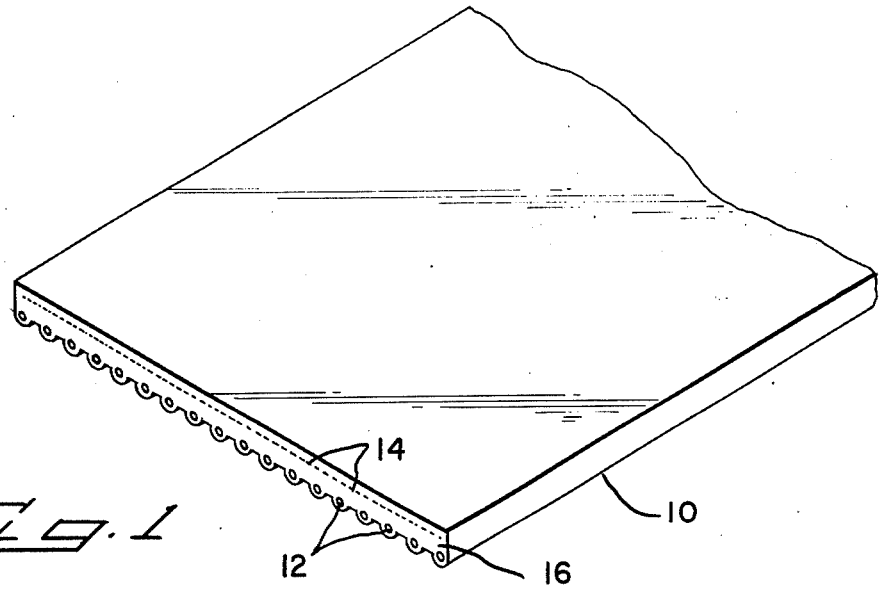
FIG. 1 is a perspective view of an end of a typical known shielded multi-conductor electrical cable.
Figure 2:
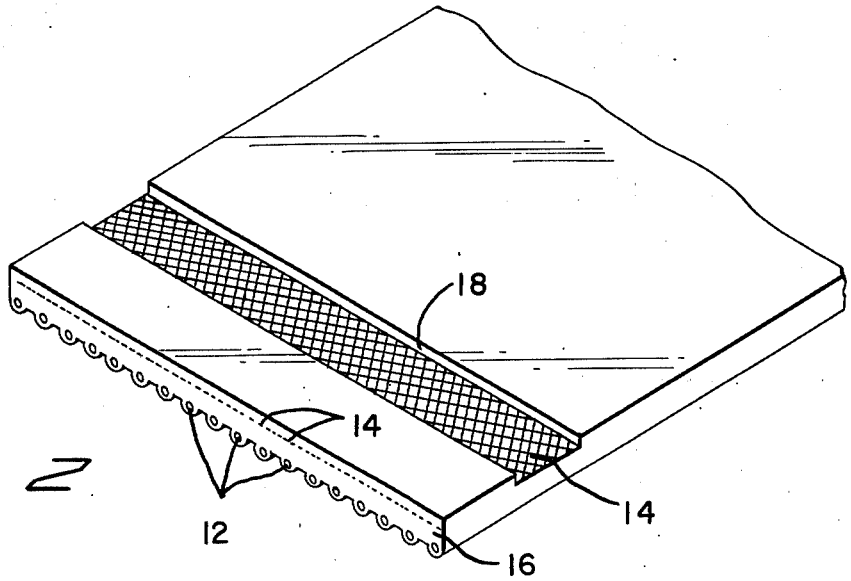
FIG. 2 is a view similar to FIG. 1 showing a section of the insulation removed to reveal a portion of the shielding layer.
Figure 3:
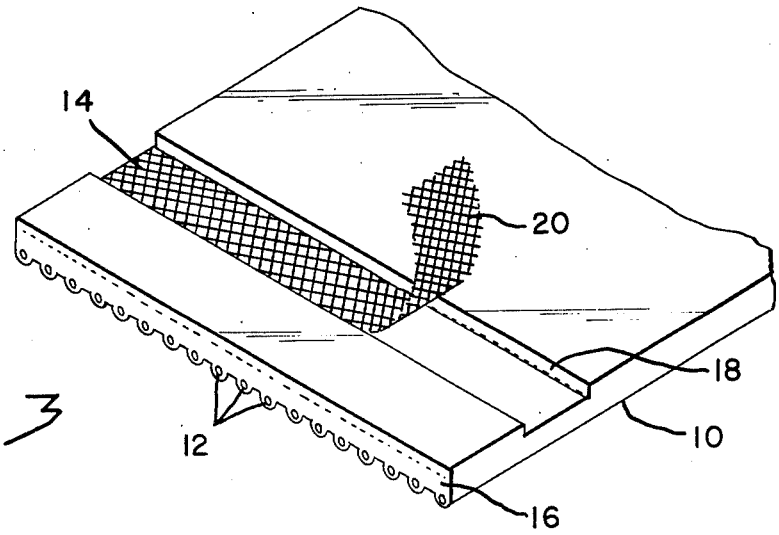
FIG. 3 is a view similar to FIGS. 1 and 2 showing the step of removing the shielding from the exposed area.
Figure 4:
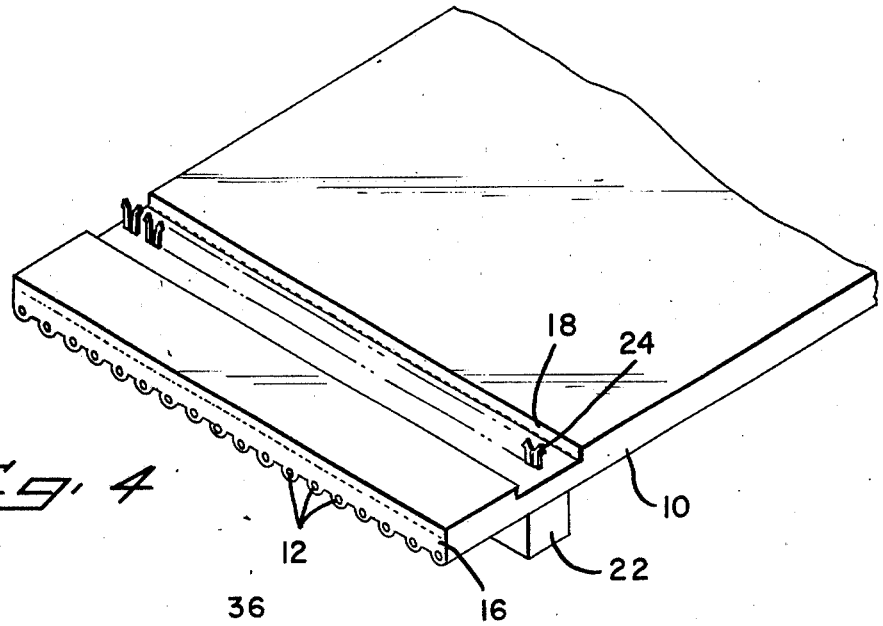
FIG. 4 is a view of the cable of FIGS. 1–3 terminated with a conventional electrical connector.

FIGS. 1 through 4 demonstrate the prior art method of terminating a shielded electrical cable. The cable 10 comprises a plurality of parellel spaced conductors 12 and a grid of metallic shielding 14 embedded in insulation 16. In order to terminate this cable, a channel 18 must be formed in the insulation to expose a portion of the shielding 14. A segment 20 of the shielding is then removed and the cable is terminated by a known connector 22 including a plurality of known insulation piercing terminals 24. This arrangement is costly and time consuming in the formation of the slot and subsequent termination and the removal of the section of shielding has a derogatory effect on the electrical characteristics of the cable.

The present invention will be described as applied to a known electrical terminal of the type shown in previously mentioned U.S. Pat. No. 3,820,055. The terminal 26 has a mating first end 28 of suitable design for engaging with a further terminal. The conductor engaging second end 30 includes a pair of parallel spaced tines 32, 34 defining therebetween an insulation displacing slot 36. The conductor engaging second end 30 of the terminal 26 is coated with a layer of insulation material 38.

Figure 5:
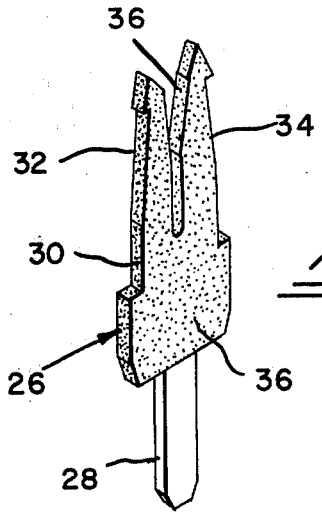
FIG. 5 is a perspective view of a typical insulation displacing electrical terminal having one end coated with a layer of insulation material in accordance with the present invention.
Figure 6:
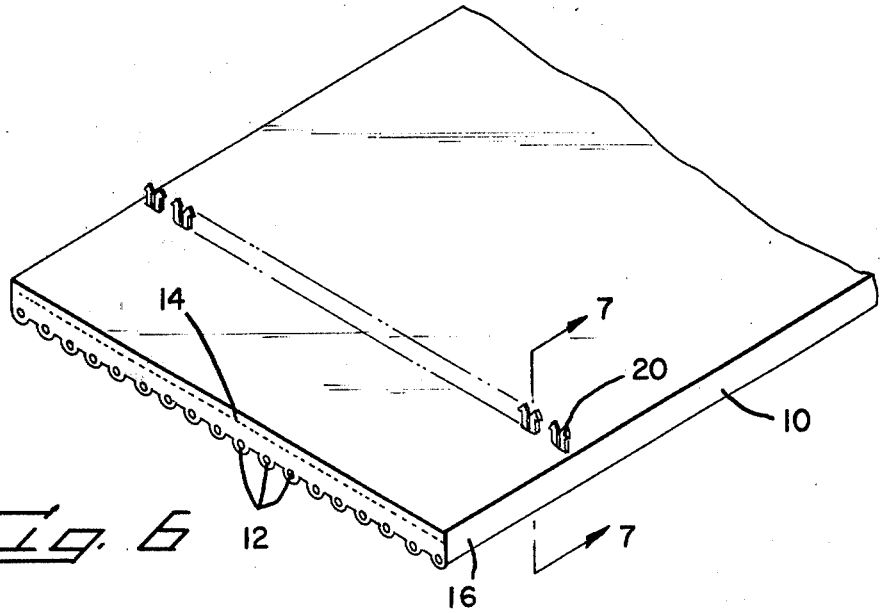
FIG. 6 is a perspective view of a shielded cable, similar to that of FIG. 1, terminated with the terminal of FIG. 5.
Figure 7:
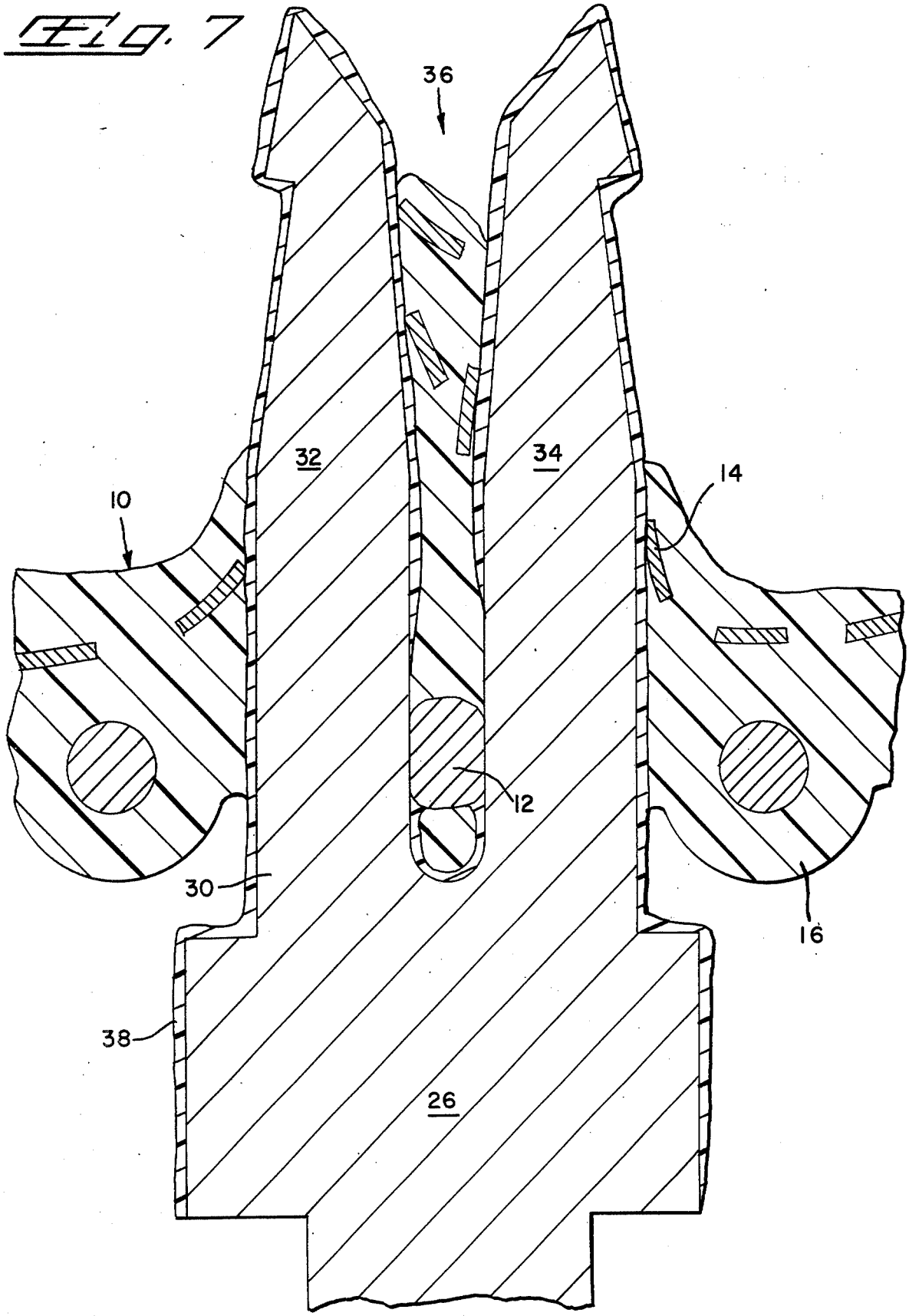
FIG. 7 is an enlarged section view taken along lines 7—7 of FIG. 6 showing the operation of the present invention.

The terminal of FIG. 5 is shown in FIGS. 6 and 7 as it would be used to terminate the previously discussed shielded cable of FIG. 1. It should be particularly noted from FIG. 6 that the termination of the cable 10 with the contacts 26 does not require the formation of a channel or the removal of any shielding prior to effecting termination. Thus, the electrical characteristics of the cable are maintained and the costs of making the termination are lowered.

The termination can most clearly be seen from FIG. 7. As the terminal 26 is forced into the cable 10, a conductor 12 is entrapped between tines 32, 34 and led into the insulation displacing slot 36. The movement of the conductor 12 in the slot will cause a certain amount of the insulation 38 to be removed therefrom by a wiping action. Electrical and mechanical contact is thus established between the conductor 12 and the terminal 26. It should also be noted that the shielding 14 is sufficiently lightweight, in comparison to the conductors 12, that during termination it is merely displaced by the terminal without disturbing the insulation layer, which will prevent establishment of an electrical contact between the shielding and the terminal.

Figure 8:
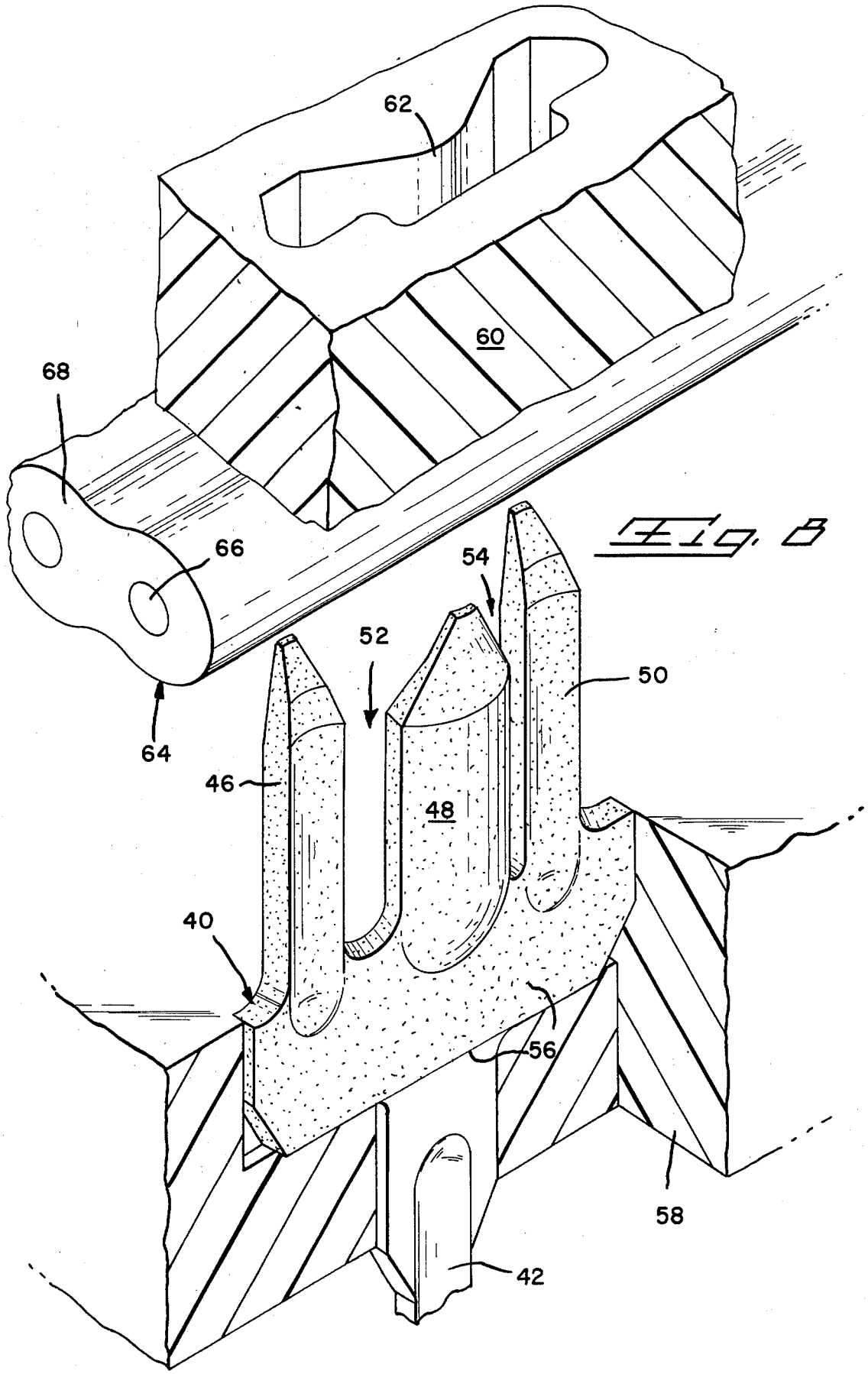
FIG. 8 is a partially exploded perspective view, partially in section, of an alternate type of insulation displacing terminal employing the present invention and utilized for terminating conductors on close center lines.
Figure 9:
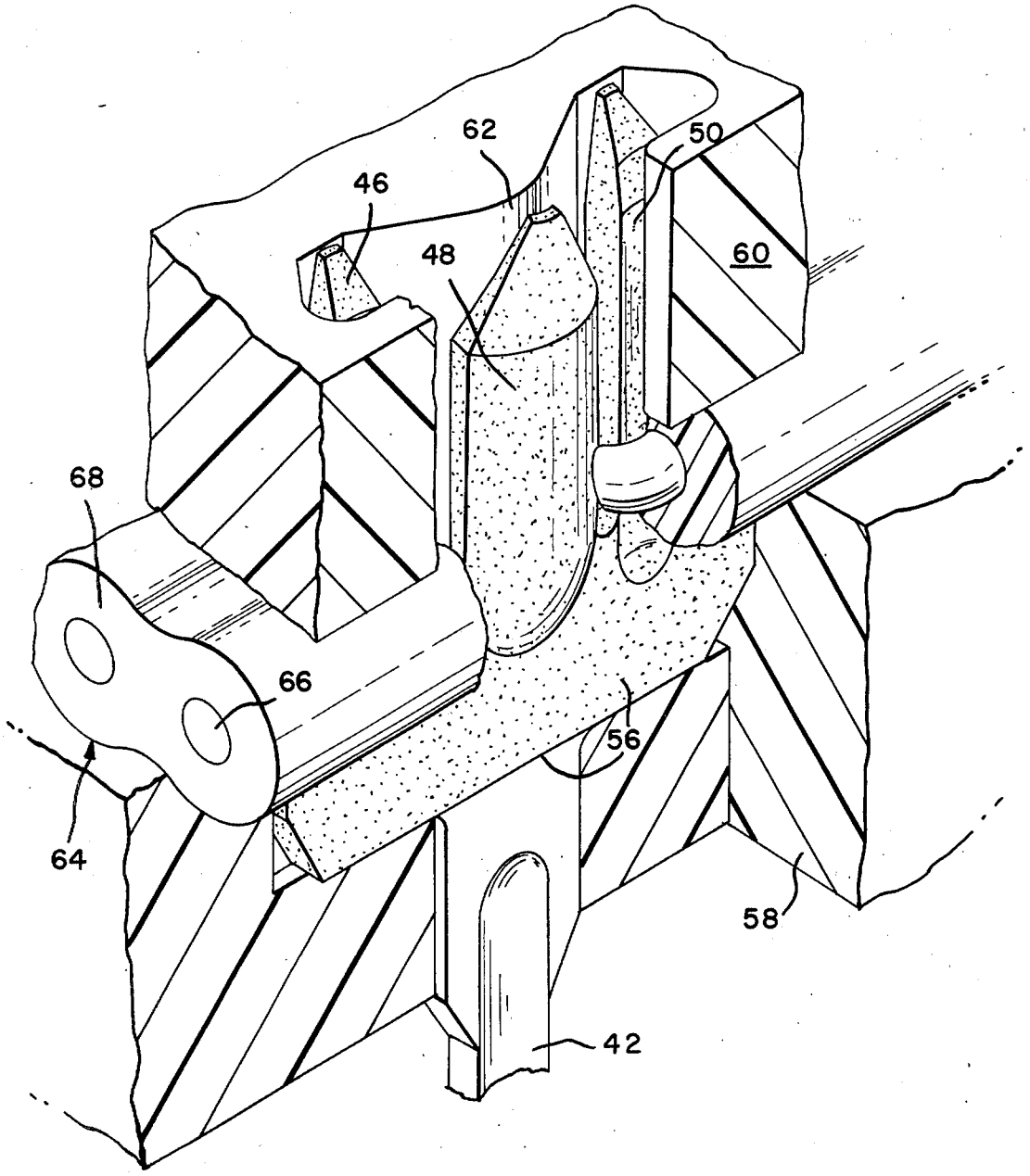
FIG. 9 is a perspective view, partially in section, similar to FIG. 8, showing the terminal in a fully engaged condition.
Figures 10, 11, 12, 13:
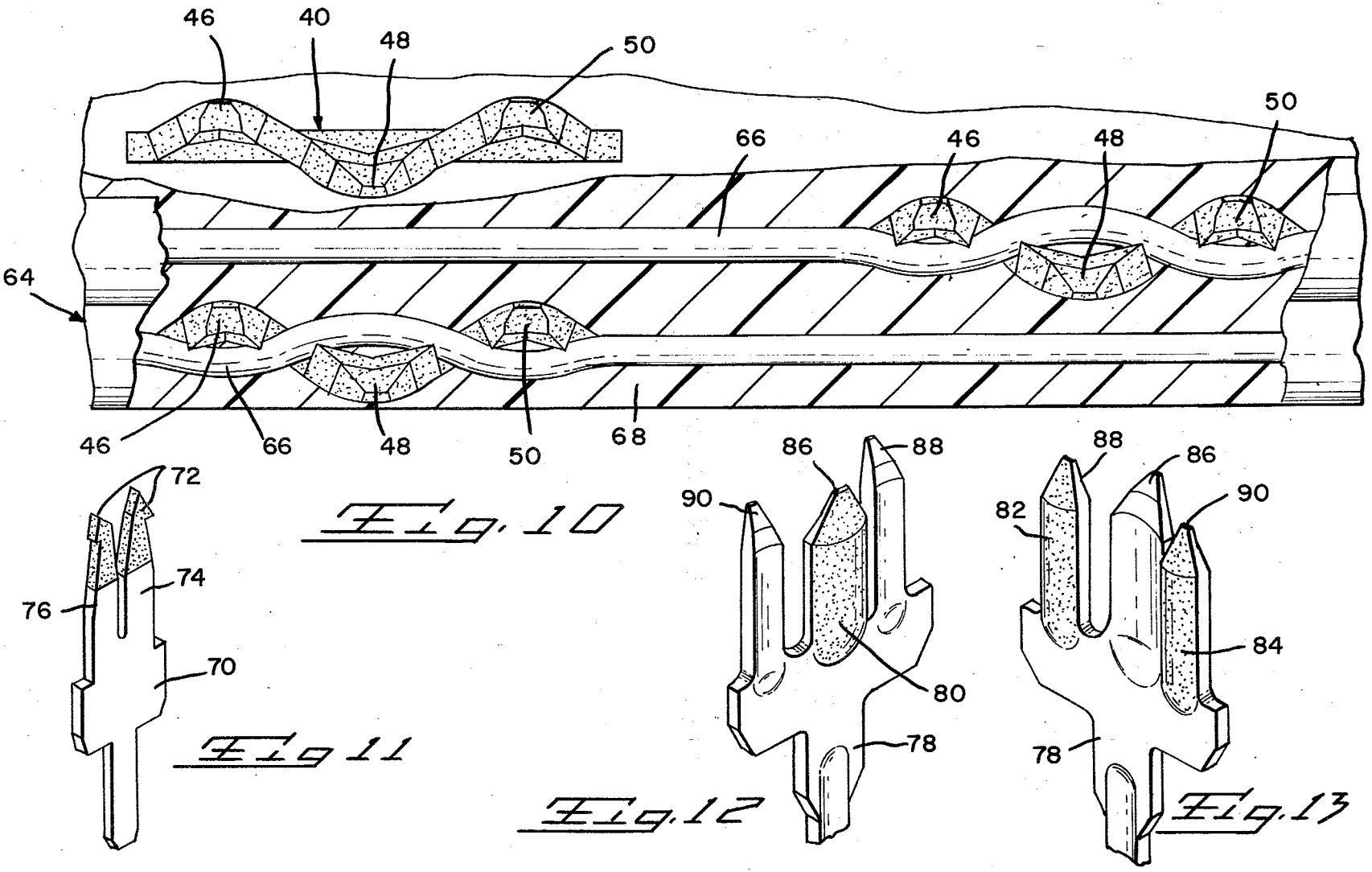
FIG. 10 is a top plan view, partially in section, showing the alternate electrical connector terminating a multi-conductor cable on close center lines.
FIG. 11 is a perspective view, similar to FIG. 5, showing a terminal having only the tips of the insulation piercing tines coated with an insulation material.
FIGS. 12 and 13 are perspective views of the obverse and reverse, respectively, sides of the terminal of FIGS. 8 to 10 showing insulation coating only selected portions of the sides thereof.

FIGS. 8 to 10 show the subject invention used in connection with the type of insulation displacing terminal 40 which is generally referred to as a linear displacement terminal. In this case the plane of the terminal 40 lies along the axis of the conductor to be terminated. The terminal 40 has a mating first end portion 42 and an insulation displacing second end portion 44 defined by parallel, spaced tines 46, 48 and 50 defining therebetween insulation displacing slots 52 and 54. The second end portion of the terminal 40 is coated with a layer of insulation 56. The terminal 40 is shown mounted in a housing base member 58 and is aligned for insertion into a cover member 60 having a profiled aperture 62 therein. The cable 64 is of conventional type having a plurality of conductors 66 embedded in insulation 68 in a closely spaced parallel arrangement.

FIG. 9 is a plan view, partially in section, showing the cable fully terminated by the connector of FIGS. 7 and 8. It can be appreciated from this view how the terminal causes the conductor to assume a tortuous path as it extends between the tines and lies within the slots. The close proximity of the terminated conductors to adjacent conductors and the various tines of the terminals to the immediately adjacent conductors can also be readily appreciated. The terminals are on a staggered arrangement to allow the greatest possible interval while maintaining the space requirements.

FIG. 11 shows an alternative to the terminal 26 of FIG. 5. While the terminal 70 is of identical configuration, the insulation coating 72 is only on the tips of the tines 74, 76. Termination with this terminal would be identical with the previous case except no wiping of insulation from the slot will occur. The insulation on the tips of the tines will prevent contact between the tines and the shielding layer of the cable.

FIGS. 12 and 13 show an alternate to the contact 40 of FIGS. 8 to 10. In this instance the terminal 78 has insulation 80, 82, 84 coating only the outer surfaces of tines 86, 88, 90, respectively. These are the surfaces which would lie most closely to the adjacent conductors and be the most likely point for shorting.

The terminals shown in the above two examples are of generally well known configuration. The terminals may be coated with a wide variety of materials including polyesters, vinyls, urethane, enamels, acrylics, metalic oxides, nylon epoxy and epoxy phenahlic resins. The coating can be accomplished by a wide variety of methods including dipping, spraying, passing through a fluidized bed of powdered material, plating and electrodeposition.

The present invention may be subject to many modifications and changes without departing from the spirit or essential characteristics thereof. The present embodiments are therefore to be considered in all respects as illustrative and not restrictive of the scope of the invention.

We claim:

1. An electrical connector for terminating multi-layered cable by contacting conductors of only a single layer, said cable having a first layer of conductors in parallel spaced alignment and at least one second layer of conductors, all layers being fully encased in insulating material with no portion of the insulation or said at least one second layer being removed to effect proper termination, said connector comprising:

a plurality of electrical terminals, each having a profiled insulation piercing and conductor engaging end portion formed by a blade shaped to pierce the insulation of said cable and including a slot dimensioned to receive a respective one of said conductors of said first layer therein in tight connecting engagement, said blade being coated with dielectric material;

a housing of insulative material having said terminals mounted therein in a closely spaced condition with said end portion exposed from a mating face; and whereby upon termination of said cable said blade shaped portions penetrate said insulation and the conductors of said first layer are forced into slots of respective terminals to make electrical contact only with the conductors of said first layer of said cable with said dielectric material preventing establishment of electrical contact with conductors of other layers of conductors of said cable, no insulation or portion of said at least one second layer of conductors being removed from said cable at the point of termination.

2. A method for terminating multi-layered cable by contacting conductors of only a single layer, said cable having a first layer of conductors in parallel spaced alignment and at least one second layer of conductors, all layers being fully encased in insulating material at the point of termination with no portion of the insulation or said at least one second layer of conductors being removed to effect said termination, said method comprising the steps of:

providing a plurality of electrical terminals, each having a profiled insulation piercing and conductor engaging end portion formed by a blade shaped to pierce the insulation of said cable and including a slot dimensioned to receive a respective one of said conductors of said first layer therein in tight connecting engagement, said blade being coated with dielectric material;

mounting said terminals in a housing in a closely spaced condition with said end portion exposed from a mating face; and terminating the conductors of the first layer of said cable with said terminals, without removal of any insulation from said cable, by forcing conductors into respective slots whereby electrical contact is made only with the conductors of said first layer of said cable by engaging in said slot and said dielectric material prevents electrical contact with conductors of other layers of said cable and adjacent terminals.

3. A method according to claim 2 wherein:

said at least one second layer of conductors of said cable is a shielding grid.

4. A method according to claim 2 wherein:

said dielectric materials are selected from the group including vinyls, enamels and urethanes.

5. A method according to claim 2 wherein:

said dielectric material is plated onto said terminals.

6. A method according to claim 2 wherein:

said dielectric material is applied in powder form by a fluidized bed process.

7. A method according to claim 2 wherein:

said dielectric material is applied to said terminals in liquid form.

8. A method according to claim 2 wherein:

said dielectric material is applied to said terminals exclusive of the conductor engaging portion.

* * * * *